US009061815B2

(12) United States Patent
Cavenagh et al.

(10) Patent No.: US 9,061,815 B2
(45) Date of Patent: Jun. 23, 2015

(54) CONTAINER ASSEMBLY AND METHODS FOR MAKING AND USING SAME

(75) Inventors: Ed Cavenagh, Winnipeg (CA); Doug Savoy, Lafayette, LA (US); Selamawit Desta, Winnipeg (CA)

(73) Assignee: SIGNODE INDUSTRIAL GROUP LLC, Glenview, IL (US)

( * ) Notice: Subject to any disclaimer, the term of this patent is extended or adjusted under 35 U.S.C. 154(b) by 249 days.

(21) Appl. No.: 13/235,268

(22) Filed: Sep. 16, 2011

(65) Prior Publication Data

US 2012/0067762 A1 Mar. 22, 2012

Related U.S. Application Data

(60) Provisional application No. 61/403,921, filed on Sep. 22, 2010.

(51) Int. Cl.
*B65D 88/16* (2006.01)

(52) U.S. Cl.
CPC ..... *B65D 88/1625* (2013.01); *Y10T 29/49826* (2015.01); *B65D 88/16* (2013.01); *B65D 88/1668* (2013.01); *B65D 88/1681* (2013.01)

(58) Field of Classification Search
CPC ..... B65D 88/16; B65D 88/1612; B65D 88/1625; B65D 88/1637; B65D 88/1668; B65D 88/26
USPC ..... 206/524.2; 220/495.01, 495.06, 62.21, 220/1.6, 23.9, 23.91; 222/105
See application file for complete search history.

(56) References Cited

U.S. PATENT DOCUMENTS

| | | | | |
|---|---|---|---|---|
| 5,018,877 | A | 5/1991 | Kantz | |
| 5,988,422 | A * | 11/1999 | Vallot | 220/62.22 |
| 6,233,965 | B1 * | 5/2001 | Choy | 62/371 |
| 7,416,091 | B2 * | 8/2008 | Yong | 220/1.6 |
| 7,775,388 | B2 * | 8/2010 | Murrer, III | 220/23.9 |
| 2003/0103695 | A1 | 6/2003 | Nickell | |

(Continued)

FOREIGN PATENT DOCUMENTS

| | | | |
|---|---|---|---|
| DE | 2328764 | A1 | 1/1975 |
| EP | 0360730 | A1 | 3/1990 |
| EP | 0376622 | A1 | 7/1990 |

(Continued)

OTHER PUBLICATIONS

International Search Report and Written Opinion of the International Searching Authority; International Application No. PCT/US2011/052624; Feb. 23, 2012; 23 pages.

(Continued)

*Primary Examiner* — Stephen Castellano
(74) *Attorney, Agent, or Firm* — Whyte Hirschboeck Dudek S.C.

(57) ABSTRACT

A container assembly and methods for making and using such an assembly are disclosed herein. In one embodiment, an assembly is configured to hold an amount of catalyst. The assembly includes a first layer forming an inner liner that, when sealed, contains the amount of catalyst. Additionally, the assembly includes a second layer that at least partly surrounds the first layer and that is substantially rigid. Further, the assembly includes a third layer that substantially completely surrounds the second layer and that is at least partly made from a woven material, the third layer including a portion forming a spout structure, and a fourth layer that at least partly surrounds the third layer.

27 Claims, 5 Drawing Sheets

(56) References Cited

U.S. PATENT DOCUMENTS

| | | | | |
|---|---|---|---|---|
| 2009/0255072 | A1* | 10/2009 | Favagrossa | 15/53.2 |
| 2010/0012550 | A1* | 1/2010 | Dedmon et al. | 206/600 |

FOREIGN PATENT DOCUMENTS

| | | | |
|---|---|---|---|
| GB | 2311773 | A | 10/1997 |
| JP | 62054994 | U | 4/1987 |
| JP | 64042238 | U | 3/1989 |
| WO | 0125101 | A1 | 4/2001 |
| WO | 0255411 | A1 | 7/2002 |

OTHER PUBLICATIONS

International Preliminary Report on Patentability and Written Opinion of the International Searching Authority; International Application No. PCT/US2011/052624; Apr. 4, 2013; 11 pages.

The Cougar Catalyst Container; Packgen; http://www.packgen.com/pg_products_cat.htm; Oct. 11, 2009; 4 pages.

* cited by examiner

CONTAINER ASSEMBLY AND METHODS FOR MAKING AND USING SAME

CROSS-REFERENCE TO RELATED APPLICATIONS

This application claims the benefit of U.S. provisional patent application No. 61/403,921, which was filed on Sep. 22, 2010 and entitled "Container Assembly and Methods for Making and Using Same", and which is hereby incorporated by reference herein.

FIELD OF THE INVENTION

The present disclosure relates to container assemblies as well as related methods of making and/or using such container assemblies and, more particularly, container assemblies that can be used to hold various materials in a sealed manner including, for example, certain catalyst materials.

BACKGROUND OF THE INVENTION

Catalysts are chemical substances that can change the rate of a chemical reaction. Such chemicals are used in the manufacture of bulk chemicals, fine chemicals, food processing and biology. In some cases, catalysts need to be isolated from the surrounding environment, particularly the surrounding atmosphere, to avoid exposure of the catalyst to surrounding elements that would potentially lead to the catalyst undergoing a chemical reaction prematurely. For example, if a presulfurized catalyst is exposed to air, it will potentially undergo an exothermic (self-heating) reaction involving the generation of sulfur dioxide. Although such a chemical reaction is not instantaneous, if left unchecked such a reaction can achieve high temperatures that may be undesirable.

It is often desired that catalysts (like many other chemicals) be stored and/or transported from time to time. That said, given the above considerations, it is desirable for containers within which catalysts are stored and/or transported to be robust and to prevent or minimize premature exposure of the catalysts to the outside environment. Nevertheless, developing such containers can be difficult, since such containers to be practical should not only be light and relatively easy to transport, but also be robust to a sufficient extent that it is unlikely that the catalysts inside the containers will be exposed to the outside environment, such as the atmosphere. In at least some cases, it would further be desirable that the container would be robust enough to continue to physically contain the catalysts even when the catalysts were exposed to the outside atmosphere and an exothermic reaction occurred.

Given the above, it would be advantageous if a new or improved container assembly for containing catalyst chemicals and/or other substances, and/or a method of making and/or a method of using such a container assembly, could be developed that addressed one or more of the above-described issues.

SUMMARY OF THE INVENTION

In an embodiment, an assembly is configured to hold an amount of catalyst. The assembly includes a first layer forming an inner liner that, when sealed, contains the amount of catalyst. Additionally, the assembly includes a second layer that at least partly surrounds the first layer and that is substantially rigid. Further, the assembly includes a third layer that substantially completely surrounds the second layer and that is at least partly made from a woven material, the third layer including a portion forming a spout structure, and a fourth layer that at least partly surrounds the third layer.

In another embodiment, a method of forming an assembly capable of containing an amount of catalyst includes providing first, second, third and fourth layers, where the first layer forms an inner liner and that, when sealed, is capable of containing the amount of catalyst, where the second layer is substantially rigid, and where the third layer is at least partly made from a woven material and includes a portion forming a spout structure. The method additionally includes inserting the third layer into the fourth layer, the second layer into the third layer, and the first layer into the second layer. In at least some one further embodiment, the method also includes fastening a hinged bottom portion of the fourth layer to a wall section of the fourth layer. In at least some additional embodiments, a method of using such an assembly (or containing material in such an assembly) is also encompassed herewithin.

In a further embodiment, a container assembly configured to hold an amount of material in a sealable manner includes first, second and third layers. The first layer forms an inner liner that, when sealed, contains the amount of catalyst, and the third layer has a portion forming a spout structure. Each of the second layer and the third layer substantially surrounds the first layer, and either the second layer substantially surrounds the third layer or the third layer substantially surrounds the second layer. The second layer is rigid or substantially rigid, and the first layer includes an entry port, an exit port, and an additional access port that allows for access into an interior region of the first layer even when the entry and exit ports are closed.

DETAILED DESCRIPTION

Figure 1:
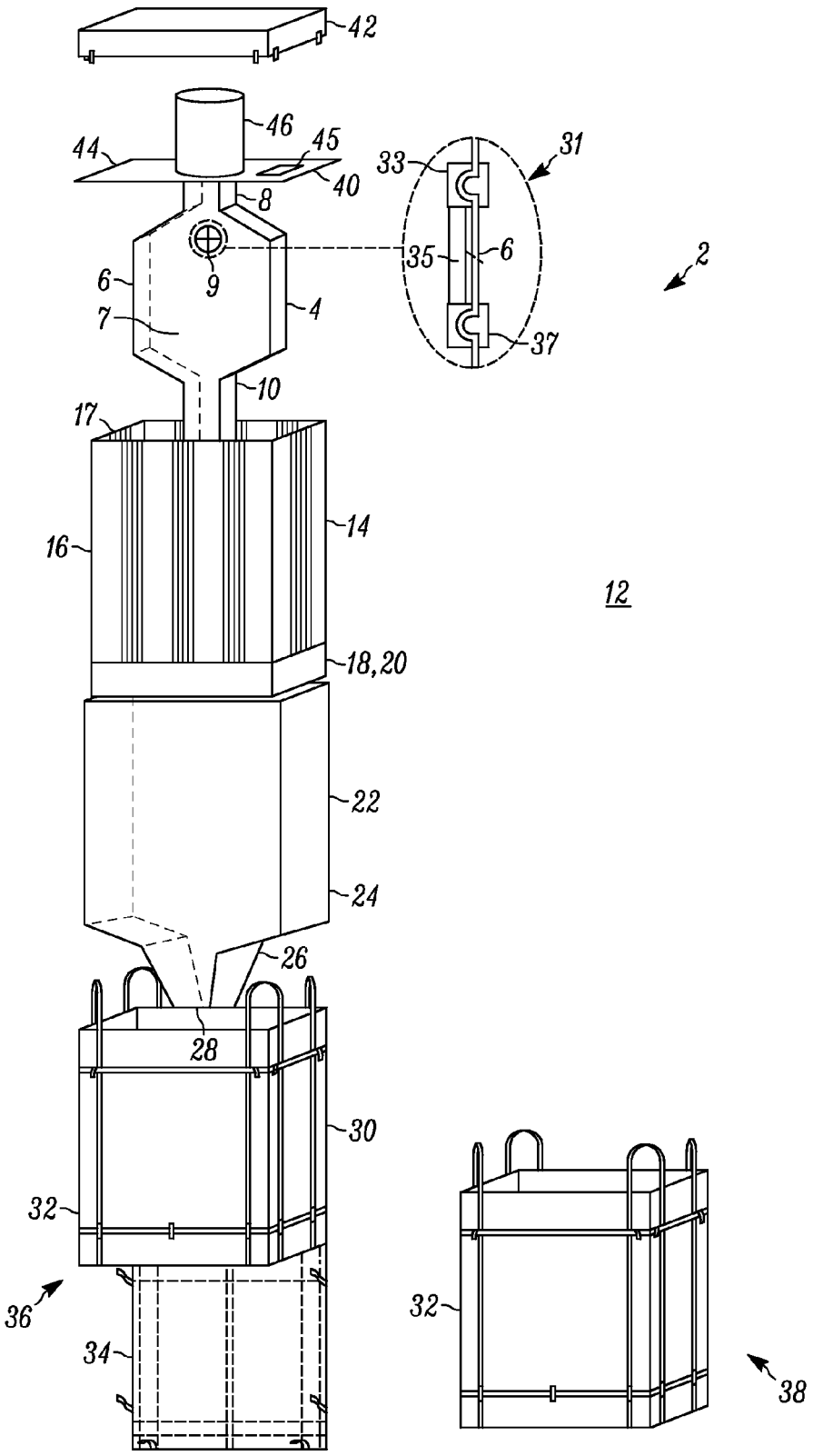
FIG. 1 is an exploded perspective view of an example container assembly in accordance with one embodiment.
Figure 2:
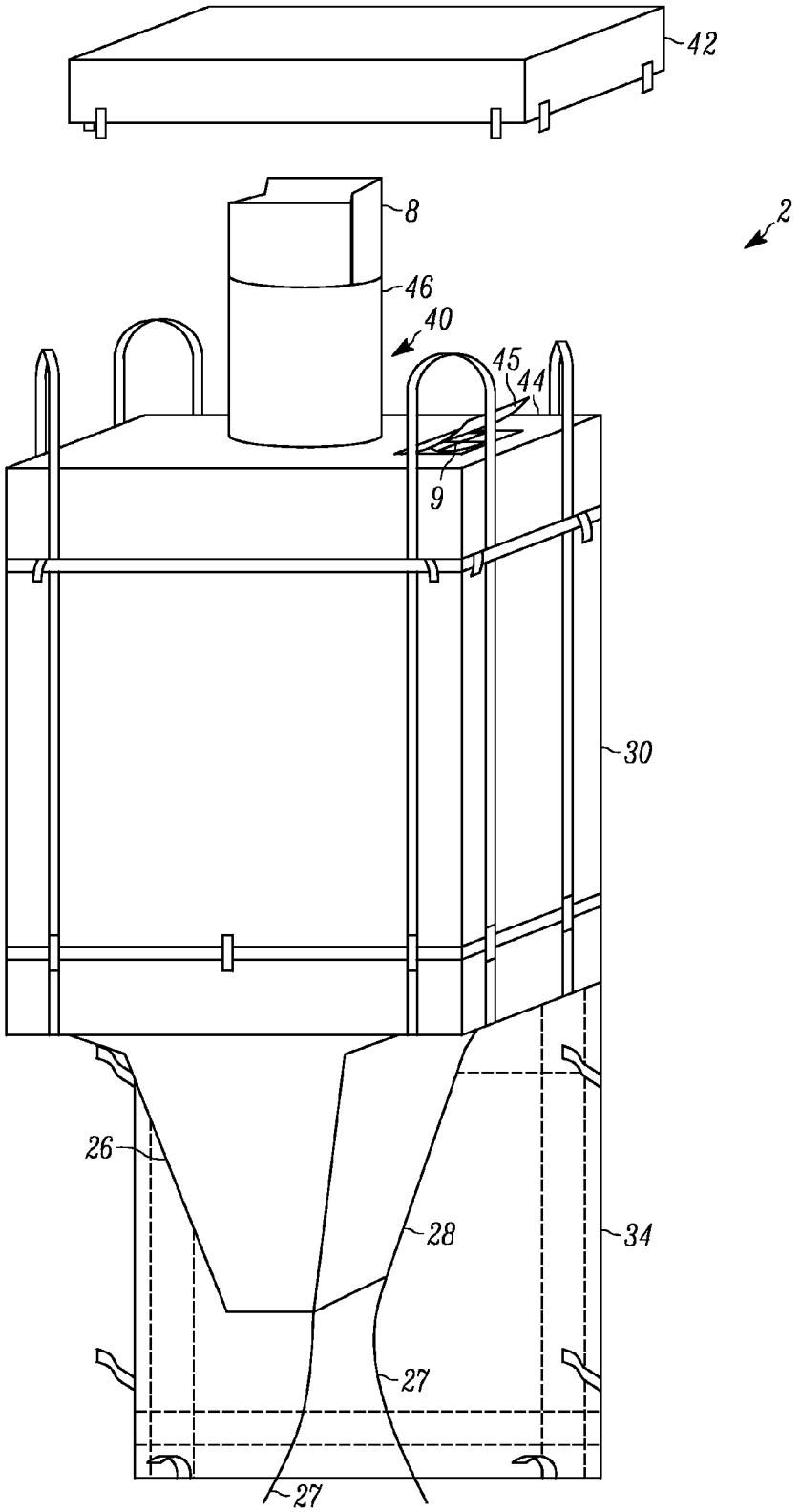
FIG. 2 is an additional perspective view of the example container assembly of FIG. 1, where the container assembly is substantially completely assembled.

Referring to FIG. 1, an exploded view of an example container assembly 2 is provided. Additionally, FIG. 2 shows the container assembly 2 when substantially completely assembled (except for a container top being still apart from the remainder of the assembly). As shown particularly in FIG. 1, the container assembly 2 includes several different structural layers, among other components.

To begin, the container assembly 2 includes an innermost first layer 4 that in the illustrated embodiment is a form-fitted liner made from polyethylene or some other impermeable material. As shown further, the first layer 4 has a main interior region wall 6 that defines an interior region 7, as well as a top throat region 8 that defines an upper orifice as well as a bottom spout region 10 that defines a lower orifice (or opening). In the present disclosure, the top throat region 8 and bottom spout region 10 are inwardly tapering or otherwise become narrower in cross-section than the interior region 7 defined by the main interior region wall 6. The first layer 4 in particular is capable of containing within the interior region 7 any of a variety of substances including, in at least some embodiments, an amount of catalyst material (not shown), which is inserted into the interior region by way of the upper orifice defined by the throat region 8. When both the upper orifice and lower orifice defined by the throat region 8 and spout region 10 are closed (for example, by tying each of the neck portions or otherwise sealing the orifices), the catalyst material and/or other substances within the first layer 4 (particularly within the interior region 7 defined by the main interior region wall 6) is/are hermetically sealed relative to an outside atmosphere 12. Additionally as shown, and as discussed further below, in at least some (but not all) embodiments, the first layer 4 also includes an access port 9 mounted along the main interior region wall 6.

When the container assembly 2 is fully assembled, the first layer 4 is positioned within a second layer 14 that in the illustrated embodiment, among other things, includes four walls that form a box-like walled structure 16 having an open top and an open bottom. In the illustrated embodiment, the walled structure 16 in particular includes a hard wall layer 17 that is formed from 3-ply corrugated cardboard. Additionally, positioned along a lower edge or rim 18 of the walled structure 16 is an additional kick plate 20 that, as described in further detail with respect to FIG. 4, includes multiple layers of polypropylene in addition to the cardboard of the wall layer 17. The second layer 14 with the wall layer 17 and the kick plate 20 along the rim 18 can serve to protect (at least to some extent) the first layer 4 against puncture or other invasive actions that might otherwise impinge the first layer 4 from a source outside of the second layer 14.

Further as shown, a third layer 22 is a woven inner layer that in particular is constructed with a woven polypropylene coated fabric and polypropylene thread. The third layer 22 as shown includes a main region 24 that is designed to surround (except for a top orifice) the second layer 14, plus a top section 40 and also a discharge spout 26 hanging down from the main region that becomes progressively narrower as one proceeds downward from the main region to a bottom end region 28 of the spout. The spout 26 in particular is intended to facilitate emptying of catalyst material from within the first layer 4 by way of the spout region 10 when it is desired to empty that catalyst out of the container assembly 2. As shown in FIG. 2 (hut is not evident in FIG. 1), the discharge spout 26 particularly includes two webbing straps 27 extending from the end region 28. The webbing straps 27 are used to interface with buckles as discussed further below.

As for the top section 40, although that portion of the third layer 22 is shown to be separated from the remainder of the third layer in FIG. 1 for convenience of illustration, it should be appreciated that actually the top section is formed as part of and integrally with, the remainder of the third layer (as shown in FIG. 2). As shown in FIG. 1, the top section 40 includes a main roof portion 44 that is substantially flat and effectively forms a top surface of the third layer 22 (extending above the main region 24, from the sidewalls of the third layer defining the main region inward), and also includes a neck or till spout 46 that extends from a middle region of the main roof portion 44. The throat region 8 of the first layer 4 can fit through the fill spout 46 when catalyst is to be added into the first layer 4, and is visible extending outward from the fill spout 46 in FIG. 2.

Also as shown in both FIGS. 1 and 2, and as described further below, in the present embodiment the main roof portion 44 includes a flap section 45 that can be closed or opened such that, when the flap section is opened, there exists an additional port through the main roof portion 44. In the present example embodiment, the flap section 45 simply is a portion of the main roof portion 44 that is cut away along several (e.g., three) edges from the remainder of the main roof portion while still being attached to (integra) with) the main roof portion along a remaining connecting edge, such that the flap section can be opened so as to expose an orifice while still remaining coupled to the main roof portion. In other embodiments, the flap section 45 can be a structure or portion of material that is distinct from the main roof portion 44 but is configured to be attached to the main roof portion so as to cover over and close an orifice formed in the main roof portion. In at least some embodiments, the flap section can have Velcro portions along its edges and the main roof portion 44 can also include complementary Velcro portions along edges of the orifice allowing for the flap section to be coupled to the remainder of the main roof portion. For example, in the embodiment shown in FIG. 1, the flap section 45 can be configured to include one or more Velcro portions along the three edges of the flap section that are cut away from the remainder of the main roof portion 44, and also one or more complementary Velcro portions along the corresponding edges of the orifice to which the Velcro portions along the edges of the flap section can be attached when the orifice is to be closed.

Additionally, the container assembly 2 also includes a fourth layer 30 that in the illustrated embodiment is an ultraviolet-light (UV) stable cubed-shaped bucket having four side walls 32 and a hinged bottom 34 as shown. FIG. 1 particularly shows both a first view 36 of the fourth layer 30 in which the hinged bottom 34 is shown in an open position relative to the side walls 32 and also a second view 38 of the fourth layer in which the hinged bottom is shown in a closed position relative to the side walls. The fourth layer 30, and particularly the side walls 32 and hinged bottom 34, can be entirely or primarily made of fiberglass, c-glass (e.g., woven e-glass), and/or other fabric with high temperature resistance. The fourth layer 30 is intended to form an outer shell that protects the first, second and third layers 4, 14 and 22, which are positioned entirely (or substantially) inside of the fourth layer when the container assembly 2 is fully assembled. In some cases, the fiberglass or c-glass of the fourth layer 30 can be backed (e.g., along interior surfaces of the fourth layer) by aluminum foil for heat shielding purposes.

Although in the present embodiment it is not envisioned that the fourth layer 30 will be substantially rigid (in contrast to the second layer 14), but rather will be flexible, in other embodiments, the fourth layer 30 can vary considerably in its rigidity. Also, the fourth layer 30 (regardless of its rigidity) can provide tensile strength. In the present embodiment, the second layer 14 particularly offers some protection to the first layer 4 as well as any catalyst (or other) contents therewithin; however, depending upon the embodiment, the fourth layer (or another layer) can also provide some protection. Additionally, the fourth layer 30 also serves to support the first, second and third layers 4, 14 and 22 as well as any contents therewithin, and is configured to facilitate grabbing/holding and transporting of the container assembly 2 as discussed further below with respect to FIG. 5. Further, opening and closing of the hinged bottom 34 allows for convenient emptying of the catalyst contents from the first layer 4 via the discharge spout 26 into a depositing region intended to receive the catalyst (e.g., a receiving structure positioned beneath the container assembly, which is not shown).

Figure 3:
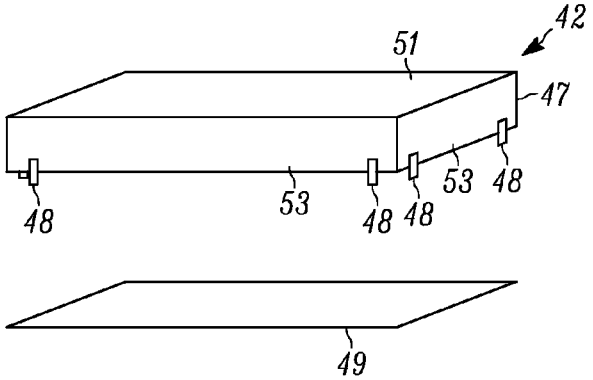
FIG. 3 is a further exploded view of certain components of a container top of the example container assembly of FIGS. 1 and 2.

Finally, related to the fourth layer 30, the container assembly 2 further includes a container top 42 as shown in FIG. 1. The container top 42 effectively forms a top or cover with respect to the outermost fourth layer 30 so as to enclose the overall container assembly 2 during transport or storage, and is removable or attachable with respect to the fourth layer 30. Referring additionally to FIG. 3 in this regard, the container top 42 is shown in more detail in a further exploded view of that top. As shown, the container top 42 more particularly includes a top closure section 47 that forms the exterior of the container top 42, and that more particularly includes a top roof surface 51 and four side surfaces 53 integrally formed with that roof surface and extending downwardly from four respective side edges of that roof surface so as to form a cavity within the top closure section. Mounted on, and extending downward from, the side surfaces 53 of the top closure section 47 additionally are several straps complete with locking device(s) (e.g., a loop, or a webbing loop) 48 by which the container top 42 can be affixed or attached to the fourth layer 30 (more particularly, affixed or attached to hooks or Velcro straps or other complementary structures on the side walls 32). In addition to the top closure section 47, the container top 42 further includes a container lid 49 that is a flat surface and is positioned inside the cavity formed within the top closure section 47 (adjacent the top interior surface of the top closure section) when the container top 42 is assembled.

Figure 4:
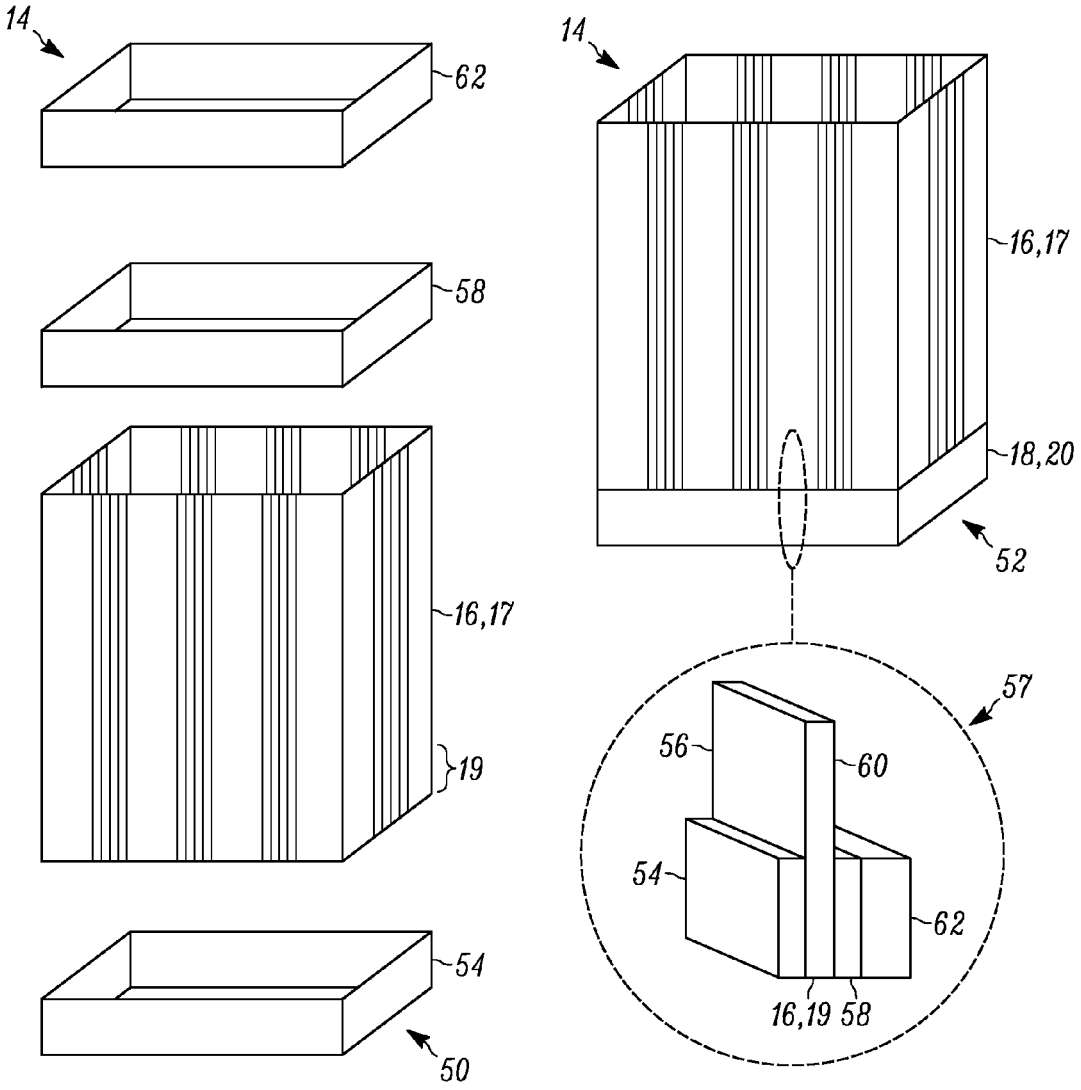
FIG. 4 is an additional exploded view of certain components of a second layer of the example container assembly of FIGS. 1 and 2.

Referring to FIG. 4, a further exploded view 50 and a further unexploded view 52 are provided of the second layer 14, along with a detail view 57 of a portion of the second layer taken from the unexploded view 52. More particularly as shown, the second layer 14 includes not only the walled structure 16 formed from the 3-ply corrugated cardboard mentioned earlier, but also includes the kick plate 20 formed along the lower rim 18 of the layer 14. As shown particularly in the exploded view 50 and the detail view 57, the kick plate 20 in particular in this embodiment is made from, in addition to a bottom rim portion 19 of the walled structure 16 itself, three additional layers that are mounted on (either directly or indirectly) that wall structure.

The three additional layers include a first woven polypropylene layer 54 that is mounted along an exterior surface 56 of the walled structure 16 along the bottom rim portion 19 and also a second woven polypropylene layer 58 that is mounted along an interior surface 60 of the walled structure 16 along the bottom rim portion 19. Finally, a non-woven polypropylene layer 62 is then in turn mounted along an interior surface of the second woven polypropylene layer portion 58, such that the layer 58 is positioned in between the layer 62 and the bottom rim portion 19 of the walled structure 16. Thus, the layer 54 is concentrically positioned around the walled structure 16 (the bottom rim portion thereof), which in turn is concentrically positioned around the layer 58, which in turn is positioned concentrically around the layer 62. Thus, the kick plate 20 can be considered to be formed by the combination of the layers 54, 58 and 62, along with the bottom rim portion 19 of the walled structure 16.

Figure 5:
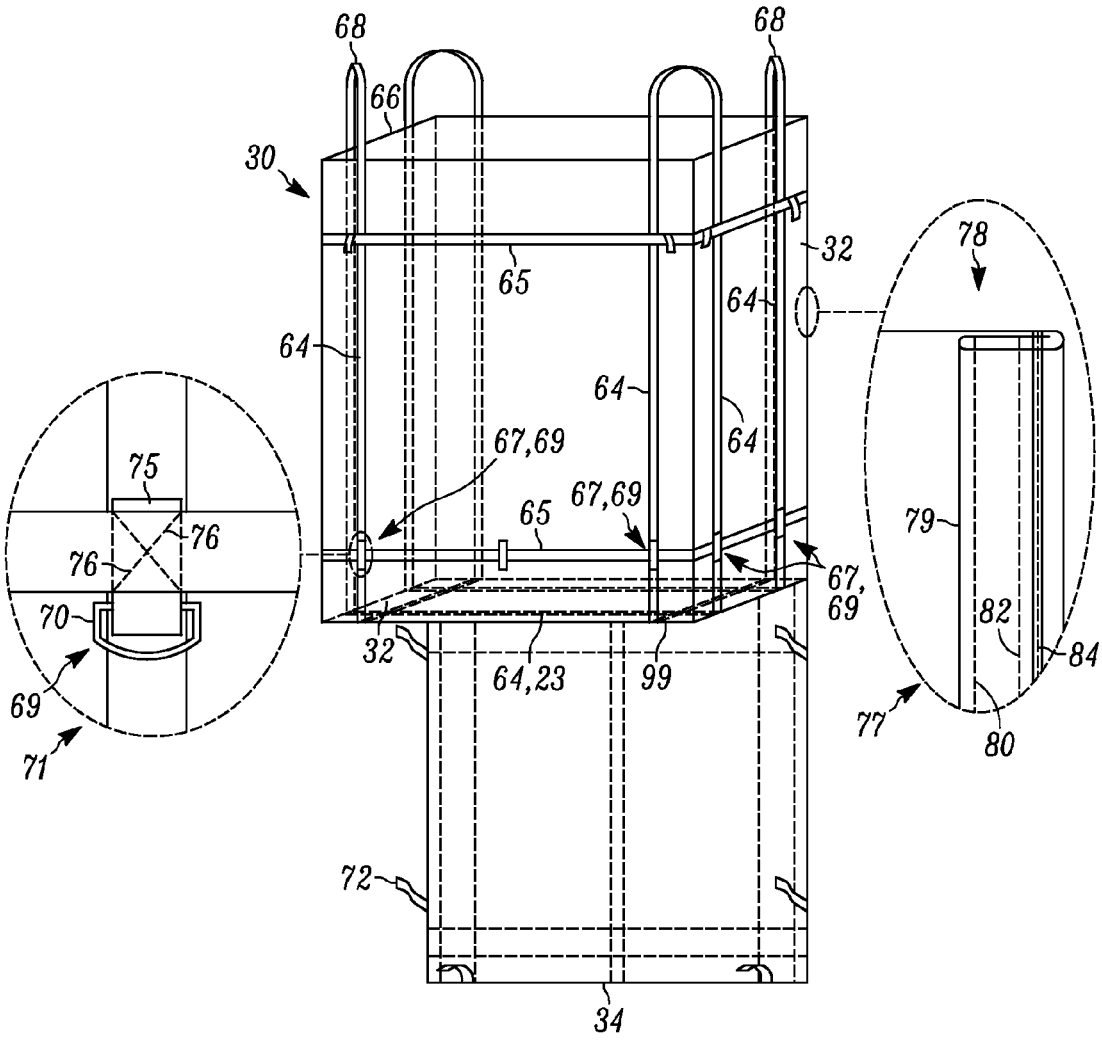
FIG. 5 is a further schematic diagram showing additional details of a fourth layer of the example container assembly of FIGS. 1 and 2.

Referring to FIG. 5, the fourth layer 30 is shown in more detail. In particular, in addition to the side walls 32 and the hinged bottom 34, it can be seen that the layer 30 also includes several vertically extending and horizontally extending seat belt straps 64 and 65, respectively. The horizontal seat belt straps 65 serve to help to further improve the structural strength of the fourth layer 30 and the container assembly 2 overall. As for the vertically extending seat belt straps 64, these straps extend beyond an upper edge 66 of the side walls 32 so as to form loops 68 that can be, among other things, grasped by a forklift or other machine when transporting or moving the overall container assembly 2. In some embodiments, including that shown in FIG. 5, the loops 68 are "cross-corner" loops that extend from one of the side walls 32 of the fourth layer 30 to another adjacent one of the side walls 32. In other embodiments, loops can be provided that have other forms, including loops that extend between non-adjacent side walls or respective loops that are respectively attached to only a single side wall.

Additionally as shown, in the present embodiment, the vertically extending seat belt straps 64 also extend beyond lower edges 99 of the side walls 32 such that respective pairs of the seat belt straps on opposite side walls 32 (directly opposite one another) are connected to one another. That is, in the present embodiment, the vertically extending seat belt straps 64 directly opposite one another on opposite ones of the side walls are actually the same strap, and a horizontally extending connecting portion 23 of that same strap extends beneath the side walls 32 and links the vertically extending portions of that same strap on the opposed side walls. FIG. 5 particularly shows in phantom how, given the presence of eight vertically extending seat belt straps 64 on the four side walls 32, there are four of the horizontally extending connecting portions 23 that link pairs of those straps directly opposed to one another on opposite ones of the side walls 32. Again, each respective one of the horizontally extending connecting portions 23 is integrally formed as part of each of the vertically extending seat belt straps 64 on opposed ones of the side walls 32, and thus itself can be considered part of these vertically extending seat belt straps (that is, part of a single strap).

As should be further appreciated from FIG. 5, the four horizontally extending connecting portions 23 cross one another in such a manner as to provide a grid underneath the side walls 32 of the fourth layer 30. This grid formed from the connecting portions 23 provides beneficial support in at least two manners. First, these four horizontally extending connecting portions 23 forming the grid improve the degree to which the vertically extending seat belt straps 64 are able to provide support for the whole container assembly 2 (e.g., when the overall container assembly 2 is being lifted by way of one or more of the loops 68). Second, the four horizontally extending connecting portions 23 forming the grid provide an additional underside support for the other layers 4, 14, and 22 within the container assembly 2 that is available both when the hinged bottom 34 is open and when the hinged bottom 34 is closed. More particularly in this regard, it can be appreciated that, even when the hinged bottom 34 is opened as shown in FIG. 5, portions of the first layer 4 (particularly when in a closed state) can rest upon and be supported by the four horizontally extending connecting portions 23. At the same time, the positioning of these four horizontally extending connecting portions 23 is sufficiently close to the lower edges 99 of the side walls 32 (that is, sufficiently close to the sides of the fourth layer) that the existence of these four horizontally extending connecting portions does not preclude the opening of the first layer 4/third layer 22 (the opening of the bottom spout region 10 and discharge spout 26) when such opening is desired; rather, the first layer 4 and third layer 22 can easily be opened and, when opened, extend within a midspace in the grid, in between the four horizontally extending connecting portions 23.

Additionally, it should be noted that along the vertically extending seat belt straps 64 proximate the bottom of the fourth layer 30 are junctions 67 between those vertical seat belt straps and a lower one of the horizontal seat belt straps 65, and at these junctions there are provided several buckle arrangements 69, one of which is particularly shown in an enlarged detail view 71 of a portion of the fourth layer 30. Each of the buckle arrangements 69 includes a respective buckle 70, which can take the form of a D-ring other forms, and which is intended to receive a respective one of several Velcro straps 72 provided along the hinged bottom 34. It should be appreciated that even though only one of the buckle arrangements 69 having a respective buckle 70 is shown in the detail view 71, similar or identical buckle arrangements and buckles are provided at each of the junctions 67 excepting possibly the junctions along the rear one of the side walls 32 to which the hinged bottom 34 is attached.

By inserting the Velcro straps 72 through the buckles 70 and wrapping the straps back around (downward from the buckles) and ultimately pressing the straps against complementary Velcro receiving surfaces, the straps and thus the hinged bottom 34 can be attached to several (or all) of the side walls 32 of the fourth layer 30. Thus, the hinged bottom 34 can be closed, thereby providing support to the other layers 4, 14 and 22 along with any catalyst (or other materials) contained within the first layer 4. In addition, it should be appreciated that the buckles 70 or other buckles (which again can take the form of D-rings or other forms) provided on the fourth layer 30 serve as attachment points for the webbing straps 27 of the third layer 22, such that the discharge spout 26 can be raised and effectively closed.

Referring again to FIGS. 1 and 2, as already mentioned, in the present embodiment the first layer 4 includes the access port 9 and the third layer includes the flap section 45. It should be appreciated that, despite the particular orientations of the access port 9 and flap section 45 shown in FIG. 1, when the first layer 4 is filled with catalyst material or other material for simply in some circumstances when it is positioned within the other layers 14, 22, 30), the access port 9 will move (due to relative movement of the main interior region wall 6 on which it is mounted) to a location that is coincident with (directly underneath) the location of the orifice within the main roof portion 44 that is opened and closed by way of the flap section 45. This relative positioning of the access port 9 and the flap section 45 is particularly evident from FIG. 2. Given such positioning, it should be appreciated that the flap section 45 allows for accessing of the access port 9, and the access port 9 further allows for accessing of the interior region 7 within the first layer 4, even when the overall container assembly 2 is fully assembled and other manners of entry into the first layer are closed of (e.g., because the throat region 8 is closed). Thus, in such circumstance, the interior region 7 can be still accessed for the purpose of taking samples of the catalyst (or other material) therewithin, or for other purposes.

In the present embodiment, the access port 9 is particularly formed as shown in a detail view 31 provided in FIG. 1, which shows a cross-section of the access port 9 taken along a plane cutting through the diameter of the access port. More particularly, the access port 9 includes a primary ring 33, a cap 35, and a secondary ring (or washer) 37. As shown, the primary ring 33 is mounted in a sealed manner upon the exterior surface of the main interior region wall 6, where the seal between the primary ring 33 and the main interior region wall can be accomplished for example by the use of glue applied along the entire circumference of the ring side surface that is in contact with the main interior region wall. Also in the present embodiment, the primary ring 33 includes screw threads along its inner circumference and the cap 35 includes complementary screw threads along its outer circumference, such that the cap 35 can be screwed into the primary ring 33 to close off in a sealed manner the orifice within the interior of the primary ring. Thus, even when the main interior region wall 6 is cut (as represented by a dashed line extending through that wall) so that an orifice is formed within that wall that is coincident (directly behind) the orifice within the primary ring 33, the cap 35 when screwed into the primary ring 33 still serves to seal off the interior region 7 of the first layer 4 from a region outside of the first layer (such as the environment 12).

Finally, in the present embodiment, the attachment of the access port 9 components to the main interior region wall 6 in a sealed manner is further accomplished not only by gluing the primary ring 33 to the main interior region wall 6 but also through the use of the secondary ring 37, which (as shown in the detail view 31) has a diameter that is the same as that of the primary ring. The secondary ring 37 particularly is intended to be glued onto the interior surface of the main interior region wall directly behind the primary ring (that, is on the opposite surface of the main interior region wall, so as to be lined up with the primary ring), and includes an annular protrusion along its side surface that interfaces the interior surface of the main interior region wall 6 that is complementary in shape to an annular recess formed along the side surface of the primary ring 33 that interfaces the exterior surface of the main interior region wall. Given this configuration, as shown, when fully implemented, the main interior region wall 6 passes between the complementary protrusion and recess of the secondary ring 37 and the primary ring 33, respectively, so as to even more fully achieve sealing of the interior region 7 within the first layer 4 from the region outside thereof (e.g., the environment 12) when the cap 35 is in place, even though the main interior region wall 6 is cut at a location corresponding to the dashed line shown in detail view 31 of FIG. 1.

Notwithstanding the description provided regarding FIGS. 1 and 2, as already noted above, in other embodiments neither an access port such as the access port 9 nor a flap section (or other access feature) such as the flap section 45 need be provided as part of the container assembly. Also, in other embodiments, the particular features of access portions can be modified from that shown. For example, in some other embodiments, the container top 42 can also include an access feature that allows for the accessing of the flap section 45 and the access port 9. Additionally, even in embodiments where the access port 9 (and flap section 45) are provided, there is no requirement that these features be utilized to access the interior of the first layer 4. Indeed, in at least some implementations of the embodiment of FIG. 1, there does not exist any cut or orifice formed in the main interior region wall 6 at the access port 9 (that is, at the location shown by the dashed line in the detail view 31) until such time as the cap 35 is first removed and a person desiring for such accessing makes such a cut. That is, in such implementations, both the cap 35/primary ring 33 and the main interior region wall 6 both are sealed until such time as there is a need to access the interior of the first layer 4 via the access port 9.

Embodiments such as those discussed above can be utilized to support/hold, store and/or transport any of a variety of catalyst materials (including, for example, presulfurized catalysts) and/or other substances. The size of the container assembly and/or weight support capabilities can vary depending upon the embodiment. In at least some embodiments, the container assembly is desirably resistant to bulging or pallet overhang.

Depending upon the embodiment, a variety of assembly or manufacturing techniques can be employed to provide the container assembly 2 or components thereof. For example, various stitching techniques can be employed to assemble components of the container assembly to achieve robustness.

For example, with respect to the fourth layer 30 as shown in FIG. 5, the vertically extending seat belt straps 64 can each be stitched to the side wails by way of two lines of 401 stitch using polyester thread extending along (slightly inwardly of) the vertically extending side edges of each vertically extending seat belt strap. In other embodiments, polypropylene thread or nylon thread or other types of thread can used instead of polyester thread for this purpose.

Also for example as shown in the detail view 71 of FIG. 5, each buckle assembly 69 can include not only a respective buckle but also a respective overlay strip 75 that extends through the respective junction 67 at which the buckle assembly is located. Further as shown, the respective vertically extending seat belt strap 64 passes in between the respective side wall 32 and the respective overlay strip 75, the respective overlay strip is positioned between that vertically extending seat belt strap and the respective horizontally extending seat belt strap 65, and the respective buckle 70 passes through and thereby is retained with respect to a cavity/slot existing between the respective vertically extending seat belt strap 64 and the respective overlay strip 75, in such embodiment, the respective overlay strip 75 and the respective horizontally and vertically extending seat belt straps 65 and 64 at each respective junction 67 can be attached to one another by way of 301 stitch using polyester thread (or, alternatively, another type of thread can be used).

Additionally as shown in a further detail view 77 of FIG. 5, one or more pairs of adjacent ones of the side walls 32 of the fourth layer 30 can be attached to one another by way of a special attachment configuration 78 including a rolled hem 79 that is rolled to the outside, a single line 301 stitch 80, and first and second lines 82 and 84, respectively, of 401 stitches, where the first line is a fiberglass inside line and the second line is a polyester thread outside line. Again, in other embodiments, polypropylene thread or nylon thread or other types of thread can be used for these purposes, or one or more portions of one or more layers are attached to one another or to one or more other components of an assembly by way of polyethylene wire.

Notwithstanding the above discussion, the present disclosure is intended to encompass numerous embodiments that include some, but not all, of the features discussed above as being part of the container assembly 2, as well as one or more other features in addition to some or all of the features discussed above. For example, while the second and fourth layers 14 and 30 take a substantially box-like or cubic appearance in the above-described embodiment, in other embodiments these layers (and the overall container assembly) can be cylindrical or some other shape. Also for example, the present disclosure is intended to encompass partially-assembled subportions of container assemblies such as the container assembly 2, discussed above (e.g., a partially-completed container assembly including only first, second and third layers 4, 14, and 22).

Further, in at least some embodiments, additional features can be included. For example, in some embodiments, the outermost fourth layer 30 will have UN (United Nations) labeling on all four of the side walls 32. Also, in some embodiments, the container assembly will have a universal pallet attachment (that is, the container assembly is capable of being attached generally to a variety of types of pallets), and/or the container assembly will able stackable (e.g., support stacking of at least two container assemblies high).

Further, in some embodiments, the container will have a safety factor of 6:1, and/or the outermost fourth layer 30 will be capable of removal and/or movement during and/or following a catalyst ignition event. Additionally, in some embodiments, the container assembly will be fire-rated to the self heating profile of catalyst. Also, in some embodiments, a heat indicator or heat sensor will be provided on the outside of the container assembly/bag to indicate if a catalyst ignition event is in progress. In some embodiments, such a heat sensor is configured to include a transmitter and/or other electrical component(s) such as a microprocessor allowing the heat sensor to send a signal (e.g., wirelessly) to a remote location indicative of a heat level that exceeds a predetermined threshold that is indicative of a catalyst ignition event or otherwise of interest. At the same time, it should be noted that, notwithstanding discussion regarding possible safety-related features (including, for example, features related to fire retardant characteristics, ignition event notification, puncture resistance, etc.), the inclusion of such discussion should not be considered to constitute any representation that any embodiments encompassed herein will be safe or satisfy any particular safety standard. Indeed, safe operation can depend on numerous factors outside of the scope of the present invention including, for example, manners of installation, maintenance, training of the individuals involved, etc.

Also, notwithstanding the usage above of terms such as "upper", "lower", "top", "bottom", "side", "downward" and other terms to describe relative positioning of various elements of the container assembly 2 relative to one another and/or other reference point(s) (e.g., to ground), it should be appreciated that the present disclosure is intended to encompass a variety of other embodiments having features that do not satisfy one or more the above relational characteristics described above. Further, the term "sealed" as discussed above is intended to encompass a variety of degrees of sealing, including for example hermetic or airtight sealing as well as sealing that involves substantial but not absolute or airtight sealing.

Figure 6:
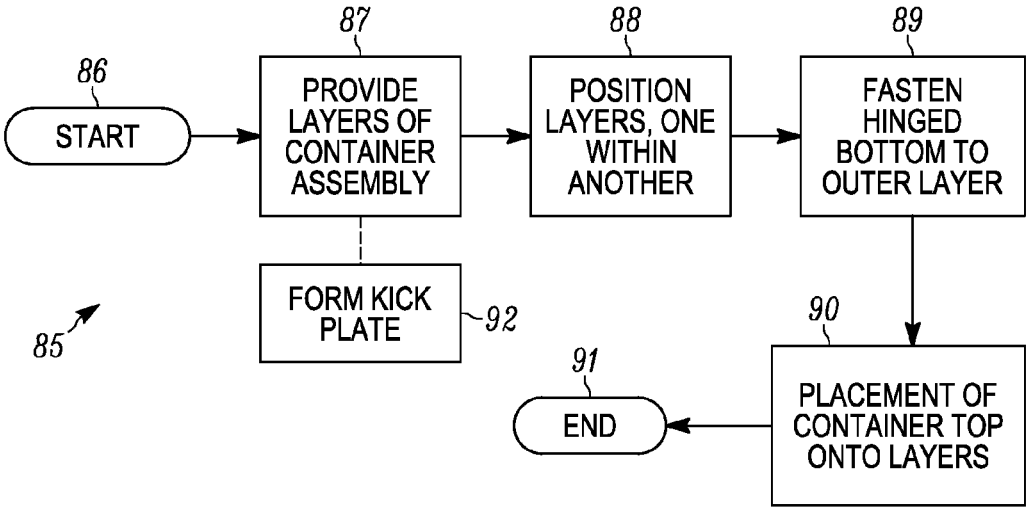
FIGS. 6 and 7 are flow chart charts respectively illustrating example steps of assembly and use of a container assembly such as that of FIGS. 1 and 2.

Referring to FIG. 6, the present disclosure is further intended to encompass methods of making container assemblies such as the container assembly 2 and other container assemblies. For example, one such method of making a container assembly involves a process 85 shown in FIG. 6 that includes several steps subsequent to a start step 86, namely, a first step 87 involving providing each of the layers 4, 14, 22 and 30 discussed above, a second step 88 involving inserting the different layers one within another (e.g., layer 4 within layer 14, layer 14 within layer 22, layer 22 within layer 30), and a third step 89 involving fastening the hinged bottom 34 of the fourth layer 30 to the side walls 32 of the fourth layer. A further step 90 in such a method, performed prior to an end step 91, can include placement of the container top 42 onto the remainder of the container assembly 2. The steps of such methods are also evident from FIGS. 1 and 2. In yet a further variation of the method of FIG. 6, the step 87 includes a substep 92 involving forming of the kick plate 20 by assembling the layers 54, 58 and 62 in relation to the bottom rim portion 19.

Figure 7:
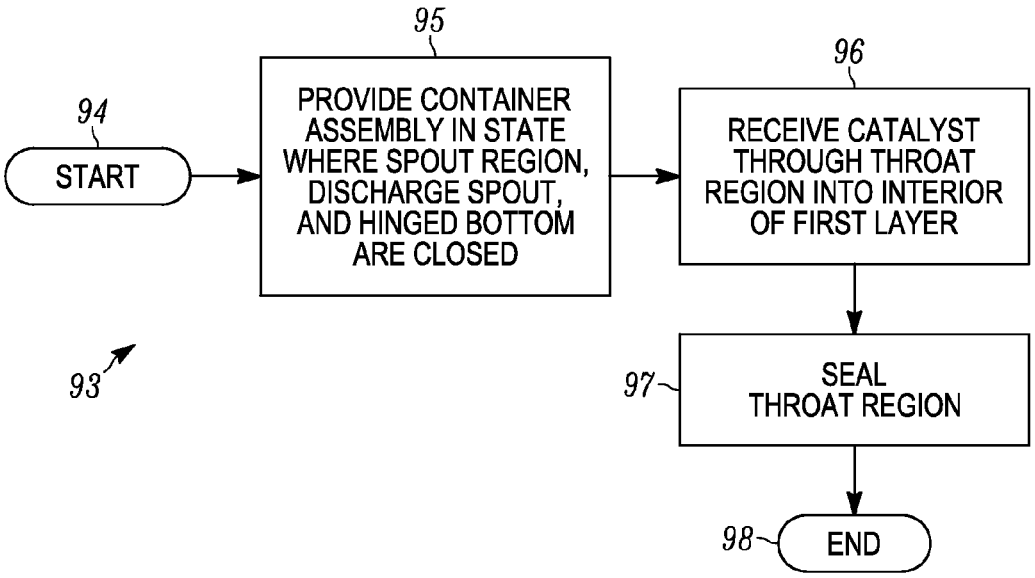

Also, the present disclosure is intended to encompass a variety of methods of filling, sealing, transporting, and otherwise utilizing the container assembly 2 and other container assemblies for one or more purposes such as storing and transporting various catalyst materials and/or other materials. Referring to FIG. 7, among other things, one method of using the container assembly 2 can include the steps of a flow chart 93. As shown, these steps begin with a start step 94, followed by a first step 95 involving providing of the container assembly 2 in a state suitable to receive catalyst (or other) material, namely, with each of the spout region 10 and discharge spout 26 closed/sealed and the hinged bottom 34 closed. Then, the process further includes a step 96 involving depositing of the catalyst (or other material) through the throat region 8 into the interior region 7 defined by the main interior region wall 6 of the first layer 4. Finally, just prior to an end step 98, the throat region 8 is sealed at a step 97. A variety of additional methods or steps are also possible depending upon the embodiment. For example, one or more processes can involve an operation involving inflation of one or more of the layers (e.g., the first layer 4) with respect to other(s) of the layers or other container components. Also, a method such as that shown in FIG. 7 can additionally include a step of accessing the interior region 7 of the first layer 4 by way of an access port such as the access port 9 discussed above, as well as subsequently closing the access port.

It should be appreciated that various changes and modifications to the embodiments described herein (including portions of the embodiments and combinations of elements of different embodiments) will be apparent to those skilled in the art. Such changes and modifications can be made without departing from the spirit and scope of the present subject matter and without diminishing its intended advantages. It is therefore intended that such changes and modifications be covered by the appended claims.

We claim:

1. An assembly configured to hold an amount of catalyst, the assembly comprising:

a first layer forming an inner liner that, when airtight sealed, contains the amount of catalyst;

a second layer that at least partly surrounds the first layer and that is substantially rigid;

a third layer that substantially completely surrounds the second layer and that is at least partly made from a woven material; and fourth layer that at least partly surrounds the third layer, wherein the fourth layer includes either e-glass or fiberglass, and wherein the fourth layer is ultraviolet-light (UV) stable and has a high temperature resistance.

2. An assembly configured to hold an amount of catalyst, the assembly comprising:

a first layer forming an inner liner that, when sealed, contains the amount of catalyst;

a second layer that at least partly surrounds the first layer and that is substantially rigid;

a third layer that substantially completely surrounds the second layer and that is at least partly made from a woven material; and a fourth layer that at least partly surrounds the third layer, wherein the fourth layer includes either e-glass or fiberglass, and wherein the fourth layer is ultraviolet-light (UV) stable and has a high temperature resistance.

3. The assembly of claim 2, wherein the first layer is a form-fitted liner made from an impermeable material, the liner including, a narrow filling opening proximate a first end of the liner, a narrow spout opening proximate a second end of the liner, and a wider containment section between the first and second ends, and wherein portions of the liner at or proximate to each of the ends of the liner can be sealed so as to seal an interior within the wider containment section from an outside atmosphere.

4. The assembly of claim 2, wherein the second layer includes at least some wall sections that are made from a cardboard material.

5. The assembly of claim 4, wherein the second layer includes four of the wail sections that together form a walled enclosure having an open top and an open bottom, and wherein one or more additional layers of woven or nonwoven polypropylene are mounted along a rim at or proximate to the bottom of the walled enclosure.

6. The assembly of claim 5, wherein a first of the additional layers is a woven polypropylene layer that is mounted along an exterior surface of the rim along or proximate to the bottom of the walled enclosure, a second of the additional layers is a woven polypropylene layer that is mounted along an interior surface of the rim at or proximate to the bottom of the walled enclosure, and a third of the additional layers is a nonwoven polypropylene layer, with the second of the additional layers being between the rim and the third additional layer.

7. The assembly of claim 2, wherein the first layer includes an access port in addition to an entry port and an exit port, wherein the access port allows for accessing of an interior region within the inner liner even when the entry port and the exit port are both closed, and wherein the access port can be repeatably opened and closed in a manner such that, when the access port is closed, the interior region is sealed relative to an outside environment.

8. The assembly of claim 7, wherein at least one of the second, third, and fourth layers includes an additional access formation by which the access port can be accessed from a location exterior of the assembly.

9. The assembly of claim 2, wherein the fourth layer forms a bucket having four side walls and a hinged bottom attached to at least one of the side walls, the hinged bottom capable of being opened so that a spout structure can extend out beyond a bottom of the side walls, and wherein the third layer includes both the spout structure and an additional fill spout structure.

10. An assembly configured to hold an amount of catalyst, the assembly comprising:

a first layer forming an inner liner that, when sealed, contains the amount of catalyst;

a second layer that at least partly surrounds the first layer and that is substantially rigid;

a third layer that substantially completely surrounds the second layer and that is at least partly made from a. woven material; and a fourth layer that at least partly surrounds the third layer, wherein the fourth layer forms a bucket having four side walls and a hinged bottom attached to at least one of the side walls, the hinged bottom capable of being opened so that a spout structure can extend out beyond a bottom of the side walls, and wherein the third layer includes both the spout structure and an additional fill spout structure.

11. The assembly of claim 10, wherein the fourth layer includes either e-glass or fiberglass, and wherein the fourth layer is ultraviolet-light (UV) stable and has a high temperature resistance.

12. The assembly of claim 10, wherein the hinged bottom can be fastened to one or more of the four side walls in a closed position by way of one or more Velcro fastener structures extending from the hinged bottom that are complementary relative to one or more buckles positioned on the one or more side walls.

13. The assembly of claim 10, wherein a plurality of straps are affixed to the fourth layer and a plurality of lifting loops attached or formed integrally with the straps extend above a top edge of the bucket.

14. The assembly of claim 13, wherein a first of the lifting loops extends across a corner of the fourth layer between a respective pair of the straps.

15. The assembly of claim 10, wherein the bucket is cubic or substantially cubic in shape, and is configured to receive a container top that substantially covers over an upper orifice of the bucket when received by the bucket, and wherein a bottom structure is hingedly attached to the fourth layer.

16. An assembly configured to hold an amount of catalyst, the assembly comprising:

a first layer forming an inner liner that, when airtight sealed, contains the amount of catalyst;

a second layer that at least partly surrounds the first layer and that is substantially rigid;

a third layer that substantially completely surrounds the second layer and that is at least partly made from a woven material; and a fourth layer that at least partly surrounds the third layer, wherein the fourth layer forms a bucket having four side walk and a hinged bottom attached to at least one of the side walls, the hinged bottom capable of being opened so that a spout structure can estend out beyond a bottom of the side walls, and wherein the third layer includes both the spout structure and an additional fill spout structure.

17. The assembly of claim 16, wherein the hinged bottom can be fastened to one or more of the four side walls in a closed position by way of one or more Velcro fastener structures extending from the hinged bottom that are complementary relative, to one or more buckles positioned on the one or more side walls.

18. The assembly of claim 16, wherein a plurality of straps are affixed to the fourth layer and a plurality of lifting loops attached or formed integrally with the straps extend above a top edge of the bucket.

19. The assembly of claim 18, wherein a first of the lilting loops extends across a corner of the fourth layer between a respective pair of the straps.

20. The assembly of claim 16, wherein the bucket is cubic or substantially cubic in shape, and is configured to receive a container top that substantially covers over an upper orifice of the bucket when received by the bucket, and wherein a bottom structure is hingedly attached to the fourth layer.

21. An assembly configured to hold an amount of catalyst, the assembly comprising:

a first layer forming an inner liner that, when airtight sealed, contains the amount of catalyst;

a second layer that at least partly surrounds the first layer and that is substantially rigid;

a third layer that substantially completely surrounds the second layer and that is at least partly made from a woven material; and a fourth layer that at least partly surrounds the third layer, wherein the third layer includes a portion forming a spout structure, wherein one or more straps extend from the spout structure and can be attached to one or more buckles attached to the fourth layer so as to close or substantially close an orifice of the spout structure.

22. An assembly configured to hold an amount of catalyst, the assembly comprising:

a first layer forming an inner liner that, when airtight sealed, contains the amount of catalyst;

a second layer that at least partly surrounds the first layer and that is substantially rigid;

a third layer that substantially completely surrounds the second layer and that is at least partly made from a woven material; and a fourth layer that at least partly surrounds the third layer, wherein the second layer includes at least some wall sections that are made from a cardboard material, and wherein the second layer includes four of the wall sections that together form a walled enclosure having open top and an open bottom, and wherein one or more additional layers of woven or nonwoven polypropylene are mounted along a rim at or proximate to the bottom of the walled enclosure.

23. The assembly of claim 22, wherein the first layer is a form-fitted liner made from an impermeable material, the liner including a narrow filling opening proximate as first end of the liner, a narrow spout opening proximate a second end of the liner, and a wider containment section between the first and second ends, and wherein portions of the liner at or proximate to each of the ends of the liner can be sealed so as to seal an interior within the wider containment section from an outside atmosphere.

24. The assembly of claim 1, wherein a first of the additional layers is a woven polypropylene layer that is mounted along an exterior surface of the rim along or proximate to the bottom of the walled enclosure, a second of the additional layers is a woven polypropylene layer that is mounted along an interior surface of the rim at or proximate to the bottom of the walled enclosure, and a third of the additional layers is a nonwoven polypropylene layer, with the second of the additional layers being between the rim and the third additional layer,

25. The assembly of claim 1, wherein the first layer includes an access port in addition to an entry port and an exit port, wherein the access port allows for accessing of an interior region within the inner liner even when the entry port and the exit port are both closed, and wherein the access port can he repeatably opened and closed in a manner such that, when the access port is closed, the interior region is sealed relative to an outside environment.

26. The assembly of claim 25, wherein at least one of the second, third, and fourth layers includes an additional access formation by which the access port can be accessed from a location exterior of the assembly.

27. The assembly of claim 1, wherein one or more portions of one or more of the layers are attached to one another or to one or more other components of the assembly by way of polyethylene wire.

* * * * *

UNITED STATES PATENT AND TRADEMARK OFFICE

CERTIFICATE OF CORRECTION

PATENT NO. : 9,061,815 B2
APPLICATION NO. : 13/235268
DATED : June 23, 2015
INVENTOR(S) : Ed Cavenagh, Doug Savoy and Selamawit Desta It is certified that error appears in the above-identified patent and that said Letters Patent is hereby corrected as shown below:

In the Claims,

Claim No. 16
Column 13, line 14, replace “estend” with --extend--

Claim No. 25
Column 14, line 41, replace “he” with --be--

Signed and Sealed this
Third Day of November, 2015

Michelle K. Lee

Michelle K. Lee
*Director of the United States Patent and Trademark Office*